US012366150B1

(12) United States Patent
Kabrich et al.

(10) Patent No.: US 12,366,150 B1
(45) Date of Patent: Jul. 22, 2025

(54) SOUND-DAMPENING PANELS FOR AN ENGINE

(71) Applicant: Caterpillar Inc., Peoria, IL (US)

(72) Inventors: Todd Ryan Kabrich, Tomball, TX (US); Timothy Josiah Lee, Morton, IL (US); Prabhu Jayaraman, Tomball, TX (US); Yuesheng He, Sugar Land, TX (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/764,925

(22) Filed: Jul. 5, 2024

(51) Int. Cl.
*E21B 43/26* (2006.01)
*F01N 1/24* (2006.01)

(52) U.S. Cl.
CPC ..... *E21B 43/2607* (2020.05); *F01N 1/24* (2013.01)

(58) Field of Classification Search
CPC ..... E21B 43/2607; F01N 1/24
See application file for complete search history.

(56) References Cited

U.S. PATENT DOCUMENTS 6,677,034 B1 * 1/2004 Hooley ..... F16C 29/025 428/323
7,632,565 B1 * 12/2009 Imam ..... B32B 15/02 428/307.3
9,587,649 B2 3/2017 Oehring
10,741,158 B1 8/2020 Aune
10,777,181 B2 * 9/2020 Topel ..... G10H 3/20
10,789,936 B2 9/2020 Lewis et al.
11,532,294 B2 * 12/2022 Hasegawa ..... G10K 11/162
11,674,475 B2 * 6/2023 Lauder ..... F02K 1/827 181/292
12,172,722 B2 * 12/2024 Reyna ..... B62D 33/042
2006/0029788 A1 * 2/2006 Lovell ..... B32B 27/065 521/155
2011/0303483 A1 * 12/2011 Quante ..... G10K 11/162 181/294
2020/0189242 A1 * 6/2020 Cai ..... E04F 15/203
2022/0412258 A1 12/2022 Li et al.

FOREIGN PATENT DOCUMENTS

CN 214304052 U 9/2021
CN 215860646 U 2/2022

OTHER PUBLICATIONS

Caterpillar, 793C XQ Mining Truck, 16 pages (2004).

* cited by examiner

*Primary Examiner* — Aaron L Lembo

(57) ABSTRACT

A hydraulic fracturing system may include a trailer having an unenclosed trailer bed, a fluid pump mounted on the unenclosed trailer bed, an engine, operably coupled to the fluid pump, mounted on the unenclosed trailer bed, and a sound-dampening system. The sound-dampening system may include a sound-dampening panel mounted on the engine. The sound-dampening panel may be configured to dampen sound produced by at least one moving part of the engine.

20 Claims, 4 Drawing Sheets

SOUND-DAMPENING PANELS FOR AN ENGINE

TECHNICAL FIELD

The present disclosure relates generally to hydraulic fracturing and, for example, to sound-dampening panels for an engine.

BACKGROUND

Hydraulic fracturing is a well stimulation technique that typically involves pumping hydraulic fracturing fluid into a wellbore at a rate and a pressure (e.g., up to 15,000 pounds per square inch (psi)) sufficient to form fractures in a rock formation surrounding the wellbore. This well stimulation technique often enhances the natural fracturing of a rock formation to increase the permeability of the rock formation, thereby improving recovery of water, oil, natural gas, and/or other fluids. The injected fluid may be pressurized by a fluid pump. A pump system, including the fluid pump, an engine, and other equipment, such as a transmission, may be mounted on a trailer to facilitate transportation of the pump system between operational sites and/or to reduce setup and teardown times. During operation, the equipment of the pump system may generate a significant amount of noise, which may be undesirable at some locations and/or times. However, a combined weight of the pump system and a sound-dampening enclosure for the trailer may exceed a weight capacity of the trailer. Accordingly, in many cases, the trailer is left unenclosed, such that the noise generated by the equipment of the pump system is unattenuated.

The sound-dampening system of the present disclosure solves one or more of the problems set forth above and/or other problems in the art.

SUMMARY

A hydraulic fracturing system may include a trailer having an unenclosed trailer bed, a fluid pump mounted on the unenclosed trailer bed, an engine, operably coupled to the fluid pump, mounted on the unenclosed trailer bed, and a sound-dampening system. The sound-dampening system may include a sound-dampening panel mounted on the engine. The sound-dampening panel may be configured to dampen sound produced by at least one moving part of the engine.

A pump system may include a fluid pump, a transmission in a transmission housing, a flywheel in a flywheel housing, an engine operably coupled to the fluid pump by the transmission and the flywheel, and a sound-dampening system. The sound-dampening system may include a first sound-dampening panel mounted on the engine, a second sound-dampening panel mounted on the transmission housing, and a third sound-dampening panel mounted on the flywheel housing.

A trailer system may include a trailer bed, an engine mounted on the trailer bed, and a sound-dampening system. The sound-dampening system may include a plurality of sound-dampening panels mounted on the engine. The plurality of sound-dampening panels may be configured to dampen sound produced by moving parts of the engine.

DETAILED DESCRIPTION

This disclosure relates to a sound-dampening system, which is applicable to any equipment that produces noise from mechanical moving parts.

Figure 1:
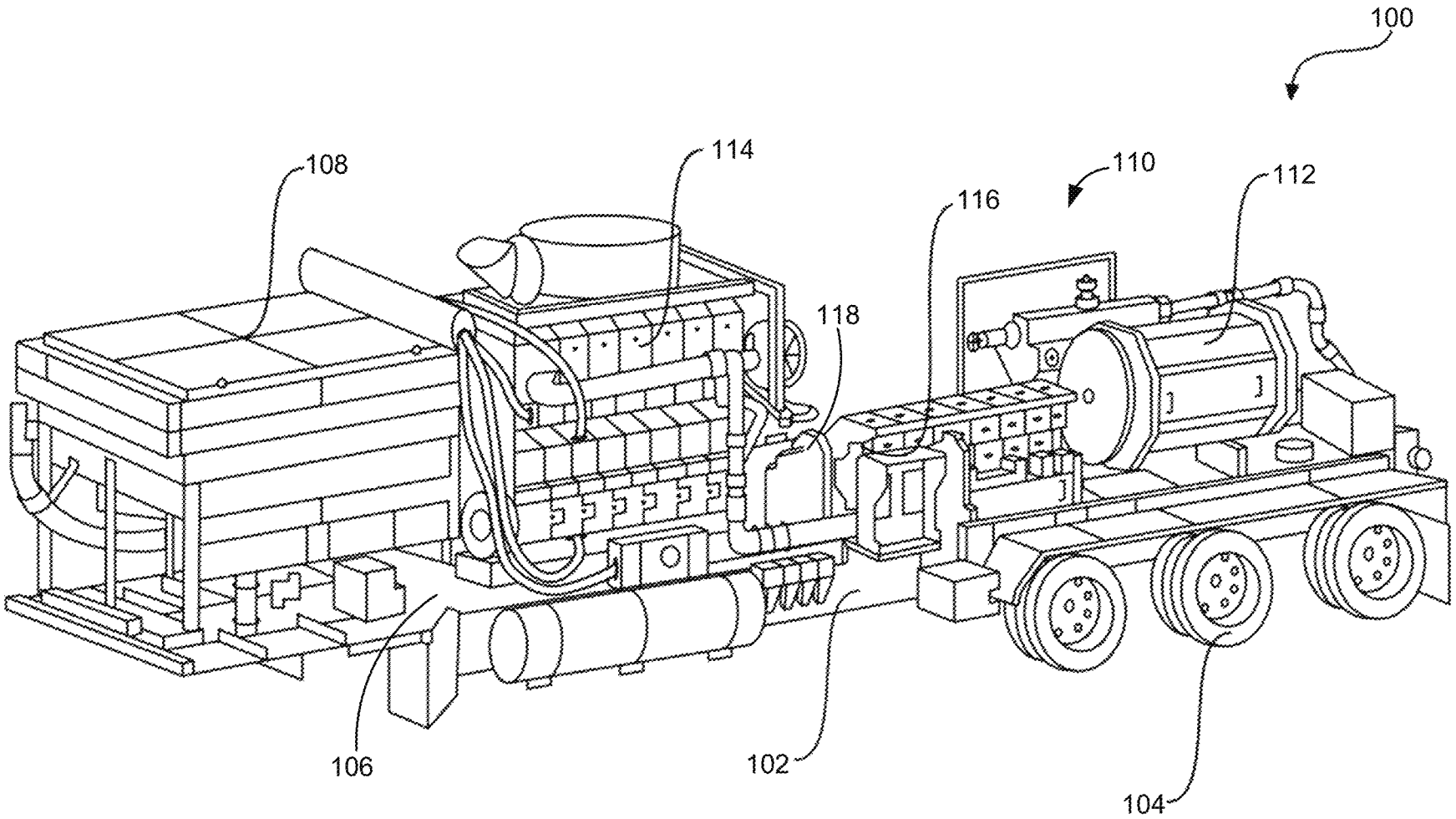
FIG. 1 is a perspective view of an example trailer.

FIG. 1 is a perspective view of an example trailer 100. The trailer 100 may be, or may be included in, a hydraulic fracturing system. For example, the trailer 100 may be used in hydraulic fracturing operations at a hydraulic fracturing site. As an example, the trailer 100 may be used in connection with high-pressure injection of fracturing fluid into a well and corresponding wellbore in order to hydraulically fracture a rock formation surrounding the wellbore. Thus, in some contexts, the trailer 100 may be referred to as a "hydraulic fracturing rig."

The trailer 100 includes a frame 102 and wheels 104 coupled to the frame 102. The wheels 104 provide mobility for the trailer 100 to enable the trailer to be hauled (e.g., by a truck or tractor unit), such as to different hydraulic fracturing sites or to different locations within a hydraulic fracturing site. The frame 102 supports a trailer bed 106 (e.g., a flat surface on which equipment can be secured and transported). The trailer bed 106 may be unenclosed. For example, the trailer 100 may lack an enclosure over the trailer bed 106. In particular, the trailer 100 may have no sound barriers, such as no side walls surrounding the trailer bed 106 and/or no roof over the trailer bed 106. However, in some implementations, the trailer 100 may include an enclosure (not shown) over the trailer bed 106.

The trailer 100 may include a cooling system 108 and/or a pump system 110 mounted on the trailer bed 106. The trailer 100 and the equipment mounted thereon may define a trailer system. The cooling system 108 may operationally cool, or otherwise remove thermal energy from, the pump system 110 and/or other components of the trailer 100. For example, the cooling system 108 may pump cooling fluid (e.g., oil, water, or the like) to components of the pump system 110 and/or other components of the trailer 100.

The pump system 110 may include a fluid pump 112, an engine 114, a transmission 116, and/or a flywheel 118, among other examples, mounted on the trailer bed 106. In some implementations, the engine 114, the transmission 116, and/or the flywheel 118 may be part of a system other than a pump system (e.g., a generator set), in which case the fluid pump 112 may be omitted. The fluid pump 112 may be a reciprocating positive-displacement pump, such as a hydraulic fracturing pump. The fluid pump 112 may include a type of high-volume hydraulic fracturing pump, such as a triplex or quintuplex pump. For example, the fluid pump 112 may have a capability to produce a maximum discharge pressure of at least 10,000 psi, at least 15,000 psi, or at least 20,000 psi. A type and/or a configuration of the fluid pump 112 may vary depending on the fracture gradient of the rock formation that will be hydraulically fractured, the quantity of fluid pumps 112 used in a hydraulic fracturing system, a flow rate necessary to complete the hydraulic fracture, the pressure necessary to complete the hydraulic fracture, or the like.

The engine 114 may be operably coupled to the fluid pump 112 via the transmission 116 and/or the flywheel 118 (e.g., the engine 114 is operably coupled to the transmission 116 and/or the flywheel 118). Thus, the engine 114 may drive the fluid pump 112, thereby providing the power for pressurization of fracturing fluid by the fluid pump 112. The engine 114 may be an internal combustion engine, such as a gaseous fuel engine (e.g., a spark-ignited gaseous fuel engine), a diesel engine (e.g., a diesel-compression ignition engine), a gasoline engine, or the like. In some implementations, the engine 114 may be turbocharged by a turbocharger (shown in FIG. 2). The transmission 116 may be a clutch transmission, a continuous variable transmission (CVT), or an automatic transmission, among other examples. In some implementations, the flywheel 118 may be coupled to the engine 114, and may be selectively engaged by a clutch of the transmission 116.

As indicated above, FIG. 1 is provided as an example. Other examples may differ from what is described with regard to FIG. 1.

Figure 2:
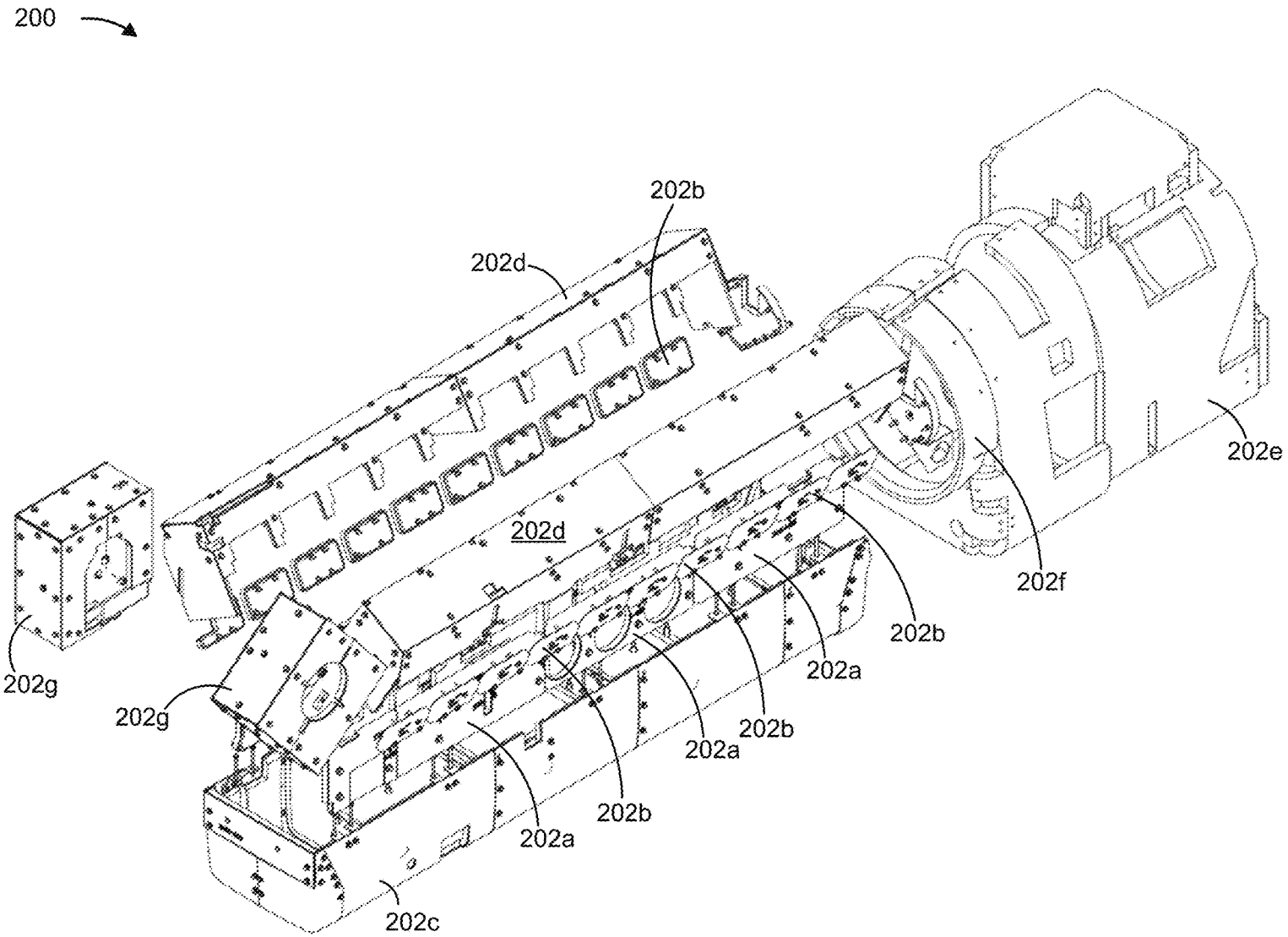
FIG. 2 is a perspective view of an example sound-dampening system.
Figure 3:
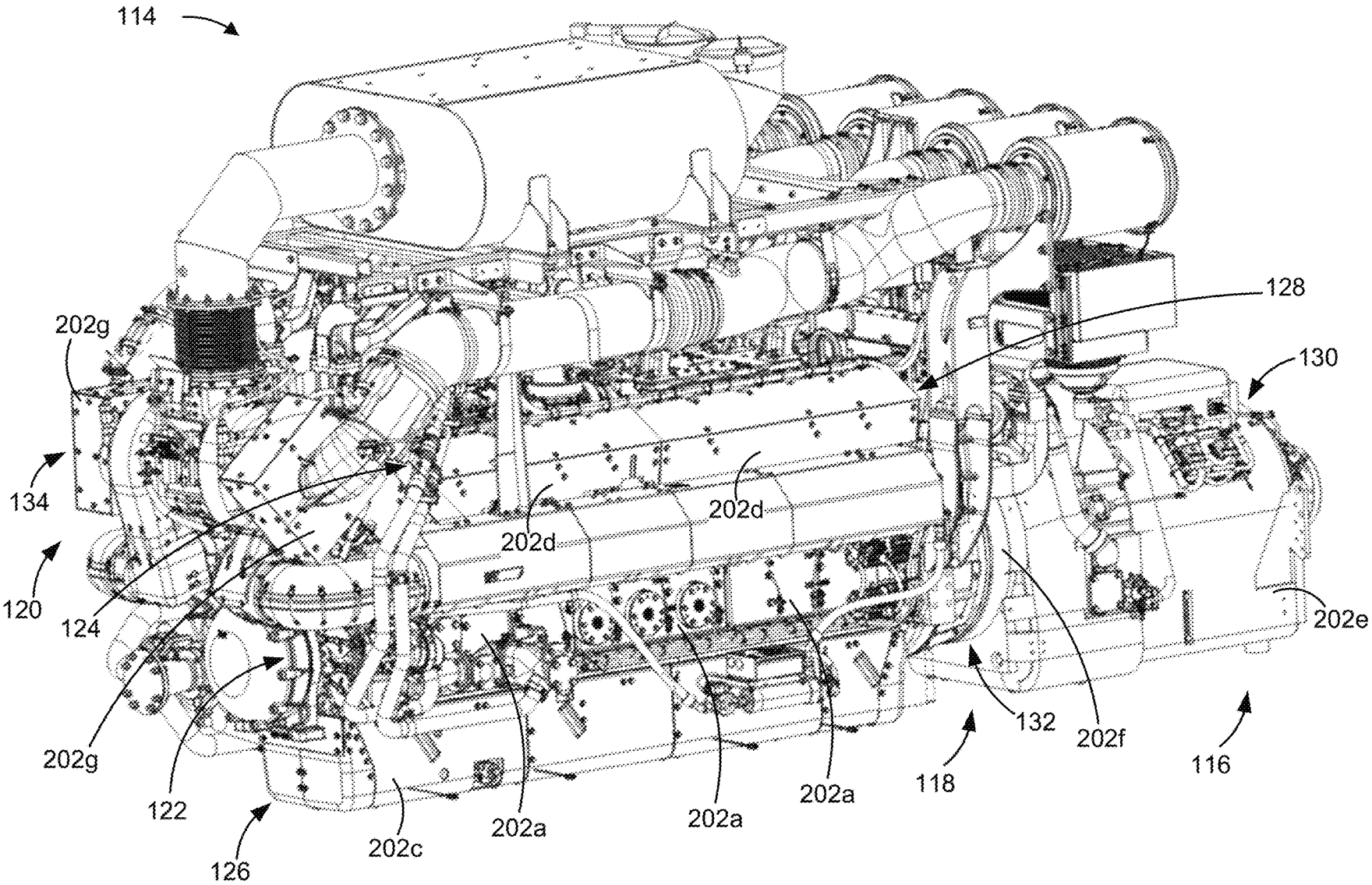
FIG. 3 shows a sound-dampening system in use on equipment.

FIG. 2 is a perspective view of an example sound-dampening system 200, and FIG. 3 shows the sound-dampening system 200 in use on equipment. The sound-dampening system 200 may include a plurality of sound-dampening panels 202. The sound-dampening panels 202 may be mounted to equipment, such as the engine 114 (shown in FIG. 3 as a gaseous fuel engine), the transmission 116, the flywheel 118, and/or a turbocharger 120, as shown in FIG. 3. Rather than forming an enclosure around an entirety of the equipment, the sound-dampening panels 202 may be mounted directly to (e.g., in contact with) various areas of the equipment. For example, the sound-dampening panels 202 may be mounted at locations on the engine 114, the transmission 116, the flywheel 118, and/or a turbocharger 120 from which sound is emitted, and the sound-dampening panels 202 are configured to attenuate sound power produced at these locations, thereby eliminating a need for an enclosure or sound barrier around the entirety of the equipment (e.g., to meet applicable noise level requirements). For example, the engine 114, the transmission 116, the flywheel 118, and/or the turbocharger 120 may be unenclosed (e.g., by a single enclosure or by respective enclosures).

Accordingly, a sound-dampening panel 202 may have one or more openings or notches to accommodate tube and/or hose connections to the equipment and/or other surface features of the equipment. The sound-dampening panels 202 may be fitted to the equipment, such as being sized and/or shaped (e.g., in two dimensions or three dimensions) to match a contour of the equipment. For example, the sound-dampening panels 202 may be form fitted to surround or cover irregular shapes (e.g., non-cylindrical shapes, non-circular shapes, and/or non-rectangular shapes) in the form of castings, forgings, stamped parts, or the like. Accordingly, the sound-dampening panels 202 may be in direct contact with the equipment over a majority (e.g., at least 50%, at least 75%, or at least 90%) of equipment-facing surfaces of the sound-dampening panels 202. A sound-dampening panel 202 is configured to dampen sound produced by at least one mechanical moving part of the equipment (e.g., of the engine 114, the transmission 116, the flywheel 118, and/or the turbocharger 120), such as a pump, a crankshaft, a valve, a piston, a gear set, a fan, or the like. "Sound dampening" may refer to a reduction in sound intensity (e.g., decibels) that reaches a measurement point distanced from (e.g., external to) the equipment.

The sound-dampening panels 202 may be mounted on the equipment using fasteners, such as bolts. In this way, the sound-dampening panels 202 may be interchangeably mounted on the equipment. For example, a sound-dampening panel 202 that is damaged or broken may be removed from the equipment, repaired or replaced, and then re-mounted to the equipment via the fasteners. As another example, a sound-dampening panel 202 may be removed from the equipment to facilitate servicing or repair of the equipment, and then re-mounted to the equipment via the fasteners.

As shown, the sound-dampening system 200 may utilize multiple different types of sound-dampening panels 202. A first type of sound-dampening panel 202 may be in a plate configuration. For example, the sound-dampening panel 202 may have an overall planar geometry (e.g., the sound-dampening panel 202 may be flat). The first type of sound-dampening panel 202 may be mounted on a flat surface (e.g., a wall) that defines a portion of an enclosure for mechanical moving parts. Here, the sound-dampening panel 202 may have a shape that corresponds to a shape of the surface. In some implementations, the first type of sound-dampening panel 202 may be flexible, to facilitate mounting conformingly on a rounded surface. The first type of sound-dampening panel 202 may include sound-dampening panels 202 mounted on an engine block 122 of the engine 114, such as sound-dampening panel 202*a* mounted on a crankcase of the engine block 122 and/or sound-dampening panels 202*b* (not visible in FIG. 3) mounted on inspection port covers 124 (e.g., to a camshaft) of the engine block 122, among other examples.

A second type of sound-dampening panel 202 may be in an enclosure configuration. Here, the sound-dampening panel 202 may have a non-planar geometry. For example, the sound-dampening panel 202 may define an enclosure (e.g., the sound-dampening panel 202 may be in the shape of an open-ended box having four or less than four side walls). In some examples, a sound-dampening panel 202 in an enclosure configuration may be composed of a unitary panel shaped to define the enclosure. In some examples, a sound-dampening panel 202 in an enclosure configuration may be composed of multiple panels (e.g., multiple planar panels) assembled to define the enclosure. The second type of sound-dampening panel 202 may be mounted over a housing that contains mechanical moving parts. Here, an enclosure defined by the sound-dampening panel 202 may be sized to enclose the housing. The second type of sound-dampening panel 202 may include sound-dampening panel 202*c* mounted on an oil pan 126 of the engine 114, sound-dampening panels 202*d* mounted on valve covers 128 of a cylinder head of the engine 114 (e.g., a single sound-dampening panel 202*d* may enclose multiple valve covers 128), sound-dampening panel 202*e* mounted on a transmission housing 130 of the transmission 116, sound-dampening panel 202*f* mounted on a flywheel housing 132 of the flywheel 118, and/or sound-dampening panels 202*g* mounted on a turbocharger housing 134 of the turbocharger 120 (e.g., a turbocharger housing 134 for a compressor), among other examples.

In some examples, the sound-dampening system 200 may include at least one sound-dampening panel 202 in a plate configuration (the first type of sound-dampening panel 202), and include at least one sound-dampening panel 202 in an enclosure configuration (the second type of sound-dampening panel 202). In some examples, the sound-dampening system 200 may include at least one sound-dampening panel 202 for the engine 114 and at least one sound-dampening panel 202 for the transmission 116, the flywheel 118, and/or the turbocharger 120, as described herein. For example, the sound-dampening system 200 may include a first sound-dampening panel 202 mounted on the engine 114, a second sound-dampening panel 202 mounted on the transmission housing 130 of the transmission 116, a third sound-dampening panel 202 mounted on the flywheel housing 132 of the flywheel 118, and/or a fourth sound-dampening panel 202 mounted on the turbocharger housing 134 of the turbocharger 120.

As indicated above, FIGS. 2-3 are provided as an example. Other examples may differ from what is described with regard to FIGS. 2-3.

Figure 4:
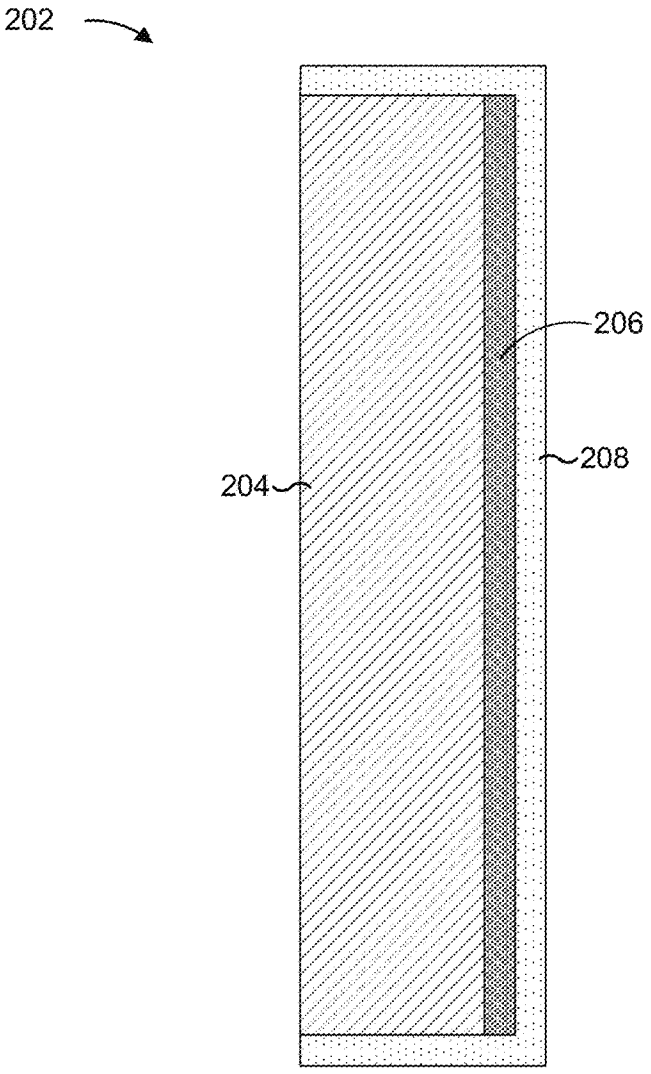
FIG. 4 is a cross-sectional view of an example sound-dampening panel.

FIG. 4 is a cross-sectional view of an example sound-dampening panel 202. The sound-dampening panel 202 may include a lamination of at least one sound-dampening layer, shown as a first sound-dampening layer 204 and a second sound-dampening layer 206, and an outer shell layer 208. For example, the outer shell layer 208 may be laminated onto the second sound-dampening layer 206, and the second sound-dampening layer 206 may be laminated onto the first sound-dampening layer 204 (e.g., the second sound-dampening layer 206 may be sandwiched between the first sound-dampening layer 204 and the outer shell layer 208).

The first sound-dampening layer 204 may be a foam layer (e.g., composed of a closed cell foam or an open cell foam). The second sound-dampening layer 206 may be a rubber layer (e.g., composed of a natural rubber or a synthetic rubber). The outer shell layer 208 may be a plastic layer (e.g., a rigid plastic layer), a fiberglass layer, a metal layer, or another material layer. In some examples, the sound-dampening panel 202 may include only two layers of the first sound-dampening layer 204, the second sound-dampening layer 206, or the outer shell layer 208. In some examples, the sound-dampening panel 202 may include only a single layer of the first sound-dampening layer 204 or the second sound-dampening layer 206.

The second sound-dampening layer 206 (e.g., which acts as a barrier layer) and the outer shell layer 208 may have similar thicknesses, while the first sound-dampening layer 204 may be significantly thicker than the second sound-dampening layer 206 and the outer shell layer 208. For example, a thickness of the first sound-dampening layer 204 may be at least 4 times, at least 5 times, or at least 6 times a thickness of the second sound-dampening layer 206, and at least 4 times, at least 5 times, or at least 6 times a thickness of the outer shell layer 208. Moreover, a thickness of the first sound-dampening layer 204 may be at least 2 times or at least 3 times a combined thickness of the second sound-dampening layer 206 and the outer shell layer 208. In some implementations, the first sound-dampening layer 204 may have a thickness of about (e.g., ±1%) 25 millimeters (mm), the second sound-dampening layer 206 may have a thickness of about 3 mm, and/or the outer shell layer 208 may have a thickness of about 4 mm. In some other implementations, the first sound-dampening layer 204 may have a thickness of 20 mm to 30 mm, the second sound-dampening layer 206 may have a thickness of 1 mm to 5 mm, and/or the outer shell layer 208 may have a thickness of 2 mm to 6 mm.

The first type of sound-dampening panel 202 and the second type of sound-dampening panel 202 may have identical layer configurations (e.g., with layers composed of the same materials and using the same layer thicknesses). Alternatively, the first type of sound-dampening panel 202 and the second type of sound-dampening panel 202 may have different layer configurations from each other. For example, the second type of sound-dampening panel 202 may employ a rigid outer shell layer 208, while the first type of sound-dampening panel 202 may employ a flexible outer shell layer 208 or may omit the outer shell layer 208.

In some implementations, the outer shell layer 208 may partially enclose the first sound-dampening layer 204 and/or the second sound-dampening layer 206, as shown. For example, a recess may be defined in the outer shell layer 208, and the first sound-dampening layer 204 and/or the second sound-dampening layer 206 may be disposed in the recess (e.g., a depth of the recess may be greater than or equal to a thickness of the first sound-dampening layer 204 and/or the second sound-dampening layer 206). Openings (e.g., reinforced openings) may be defined through at least the outer shell layer 208 to receive fasteners (e.g., bolts) for mounting the sound-dampening panel 202. The openings may extend through the first sound-dampening layer 204 and the second sound-dampening layer 206, or the first sound-dampening layer 204 and a second sound-dampening layer 206 may be shaped so as not to obstruct the openings through the outer shell layer 208.

As indicated above, FIG. 4 is provided as an example. Other examples may differ from what is described with regard to FIG. 4.

Some implementations described herein relate to a method to dampen air borne noise emanating from one or more external surfaces of an engine, transmission, flywheel, turbocharger, or hydraulic fracturing pump to meet air borne regulatory requirements without a separate sound enclosure, the method comprising providing one or more sound panels that are configured to reduce a detectable noise level associated with the respective one or more external surfaces, the one or more sound panels including at least one sound-dampening material layer, and the one or more sound panels being compatible with only a subset of the engine, transmission, flywheel, turbocharger, or hydraulic fracturing pump; and applying the one or more sound panels in contact with the respective external surfaces.

INDUSTRIAL APPLICABILITY

The sound-dampening system 200 described herein may be used with any equipment that generates significant amounts of noise. For example, the sound-dampening system 200 may be used with equipment, such as the engine 114, the transmission 116, the flywheel 118, and/or the turbocharger 120, mounted to the trailer 100, which may be used in connection with hydraulic fracturing operations. During operation, noise generated by the equipment may be undesirable at some locations and/or times. However, the trailer 100 may lack an enclosure to attenuate noise because the additional weight of the enclosure may exceed a weight capacity of the trailer 100.

The sound-dampening system 200 described herein employs sound-dampening panels 202 that mount directly to equipment on the trailer 100. The sound-dampening panels 202 contain sound-dampening layers that provide effective sound dampening, while also being lightweight and therefore not contributing significantly to the weight on the trailer 100. In this way, the sound-dampening system 200 can be used for effective sound dampening for an unenclosed trailer 100, thereby facilitating operation of the equipment (e.g., for hydraulic fracturing operations) at locations and/or times in which the equipment would otherwise be too noisy. Moreover, the sound-dampening panels 202 are interchangeably mounted to the equipment, thereby facilitating fast and efficient servicing of the sound-dampening panels 202 and/or the equipment.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. A hydraulic fracturing system, comprising:

a trailer having an unenclosed trailer bed;

a fluid pump mounted on the unenclosed trailer bed;

an engine, operably coupled to the fluid pump, mounted on the unenclosed trailer bed; and a sound-dampening system comprising a sound-dampening panel mounted on the engine, the sound-dampening panel configured to dampen sound produced by at least one moving part of the engine.

2. The hydraulic fracturing system of claim 1, wherein the sound-dampening panel comprises at least one sound-dampening layer and an outer shell layer laminated onto the at least one sound-dampening layer.

3. The hydraulic fracturing system of claim 1, wherein the sound-dampening panel comprises a lamination of a foam layer, a rubber layer, and a plastic layer, and wherein a thickness of the foam layer is at least 5 times a thickness of the rubber layer and at least 5 times a thickness of the plastic layer.

4. The hydraulic fracturing system of claim 1, wherein the sound-dampening panel is in a plate configuration, and wherein the sound-dampening panel is mounted on a surface of the engine.

5. The hydraulic fracturing system of claim 1, wherein the sound-dampening panel is in an enclosure configuration, and wherein the sound-dampening panel is mounted over a housing of the engine.

6. The hydraulic fracturing system of claim 1, wherein the sound-dampening panel is flexible, and wherein the sound-dampening panel is mounted conformingly on a rounded surface of the engine.

7. The hydraulic fracturing system of claim 1, wherein the sound-dampening panel is in a plate configuration and mounted on a surface of the engine, and wherein the sound-dampening system further comprises an additional sound-dampening panel in an enclosure configuration that is mounted over a housing of the engine.

8. The hydraulic fracturing system of claim 1, wherein the sound-dampening panel is mounted over an oil pan, on a crankcase of an engine block, on an inspection port cover of the engine block, or over a plurality of valve covers.

9. The hydraulic fracturing system of claim 1, further comprising a turbocharger connected to the engine, wherein the sound-dampening system further comprises an additional sound-dampening panel mounted on a turbocharger housing of the turbocharger.

10. The hydraulic fracturing system of claim 1, further comprising a transmission and a flywheel coupling the engine to the fluid pump, wherein the sound-dampening system further comprises an additional sound-dampening panel mounted on a transmission housing of the transmission or a flywheel housing of the flywheel.

11. The hydraulic fracturing system of claim 1, wherein the sound-dampening panel is mounted at a location on the engine from which sound is emitted, and the sound-dampening panel is form fitted to match a contour of the engine at the location.

12. A pump system, comprising:

a fluid pump;

a transmission in a transmission housing;

a flywheel in a flywheel housing;

an engine operably coupled to the fluid pump by the transmission and the flywheel; and a sound-dampening system, comprising:

a first sound-dampening panel mounted on the engine;

a second sound-dampening panel mounted on the transmission housing; and a third sound-dampening panel mounted on the flywheel housing.

13. The pump system of claim 12, further comprising a turbocharger, in a turbocharger housing, connected to the engine, wherein the sound-dampening system further comprises a fourth sound-dampening panel mounted on the turbocharger housing.

14. The pump system of claim 12, wherein the first sound-dampening panel is in a plate configuration, and wherein the first sound-dampening panel is mounted on a surface of the engine.

15. The pump system of claim 12, wherein the first sound-dampening panel is in an enclosure configuration, and wherein the first sound-dampening panel is mounted over a housing of the engine.

16. The pump system of claim 12, wherein the first sound-dampening panel is mounted at a location on the engine from which sound is emitted, and the first sound-dampening panel is form fitted to match a contour of the engine at the location on the engine, wherein the second sound-dampening panel is mounted at a location on the transmission housing from which sound is emitted, and the second sound-dampening panel is form fitted to match a contour of the transmission housing at the location of the transmission housing, and wherein the third sound-dampening panel is mounted at a location on the flywheel housing from which sound is emitted, and the third sound-dampening panel is form fitted to match a contour of the flywheel housing at the location on the flywheel housing.

17. A trailer system, comprising:

a trailer bed;

an engine mounted on the trailer bed; and a sound-dampening system comprising a plurality of sound-dampening panels mounted on the engine, the plurality of sound-dampening panels configured to dampen sound produced by moving parts of the engine.

18. The trailer system of claim 17, wherein the plurality of sound-dampening panels are mounted respectively over an oil pan, on a crankcase of an engine block, on an inspection port cover of the engine block, and over a plurality of valve covers.

19. The trailer system of claim 17, further comprising a turbocharger connected to the engine, wherein the sound-dampening system further comprises an additional sound-dampening panel mounted on a turbocharger housing of the turbocharger.

20. The trailer system of claim 17, wherein the plurality of sound-dampening panels include:

a first sound-dampening panel in a plate configuration that is mounted on a surface of the engine, and a second sound-dampening panel in an enclosure configuration that is mounted over a housing of the engine.

* * * * *